US010711655B1

(12) United States Patent
Hattiangadi et al.

(10) Patent No.: US 10,711,655 B1
(45) Date of Patent: Jul. 14, 2020

(54) ROCKER ARM ASSEMBLY HAVING A HYDRAULIC LASH ADJUSTER

(71) Applicant: Caterpillar Inc., Peoria, IL (US)

(72) Inventors: Ashwin A. Hattiangadi, Edwards, IL (US); Charles F. Coffey, Peoria, IL (US); Kevin D. Yoder, Peoria Heights, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/594,238

(22) Filed: Oct. 7, 2019

(51) Int. Cl.
*F01L 1/34* (2006.01)
*F01L 1/24* (2006.01)
(Continued)

(52) U.S. Cl.
CPC ..... *F01L 1/2405* (2013.01); *F01L 1/18* (2013.01); *F01L 2001/2433* (2013.01); *F01L 2003/11* (2013.01)

(58) Field of Classification Search
CPC ... F01L 1/2405; F01L 1/18; F01L 2001/2433; F01L 2003/11
See application file for complete search history.

(56) References Cited

U.S. PATENT DOCUMENTS 5,088,458 A 2/1992 Wakeman et al.
7,493,879 B2 2/2009 Fujii et al.
(Continued)

FOREIGN PATENT DOCUMENTS

GB 2542600 A 9/2015
JP 59218316 A 12/1984
WO 2017032364 A1 3/2017

*Primary Examiner* — Zelalem Eshete
(74) *Attorney, Agent, or Firm* — Calfee, Halter & Griswold LLP

(57) ABSTRACT

A method of retrofitting a rocker arm assembly for an engine includes removing a first rocker arm assembly from the engine such that a camshaft of the engine remains in the engine. The method also includes providing a second rocker arm assembly that includes a rocker shaft, a rocker arm, a pushrod, and a hydraulic lash adjuster. The rocker arm is connected to the rocker shaft such that the rocker arm can pivot relative to the rocker shaft. The rocker arm has a first end, a second end, and a first oil passage. The pushrod has a top end and a bottom end, in which the top end is connected to the second end of the rocker arm and the bottom end is configured for engaging a camshaft of the engine. The hydraulic lash adjuster includes a housing, a first body member, a second body member, a check valve, and a biasing member. The first body member is disposed in the housing such that a first radial clearance exists between an outer surface of the first body member and an inner surface of the housing. The first body member has a first bore and an opening in fluid communication with the first oil passage of the rocker arm. The second body member is disposed in the first bore of the first body member such that a second radial clearance exists between the inner surface of the first bore of the first body member and an outer surface of the second body member. The second radial clearance is less than the first radial clearance. The check valve is configured to allow oil to flow through the opening of the first body member when the check valve is in an open position and configured to prevent the flow of oil through the opening when the check valve is in the closed position. The biasing member is disposed in a second bore of the second body member. The method further includes inserting the second rocker arm assembly into the engine such that the bottom end of the pushrod engages the camshaft of the engine and the front end of the rocker arm engages a valve assembly of the engine.

20 Claims, 6 Drawing Sheets

(51) Int. Cl.
*F01L 1/18* (2006.01)
*F01L 3/00* (2006.01)

(56) References Cited

U.S. PATENT DOCUMENTS

| | | | | |
|---|---|---|---|---|
| 8,065,987 | B2 | 11/2011 | Yang | |
| 10,294,828 | B2 | 5/2019 | Cecur | |
| 2010/0037854 | A1 * | 2/2010 | Yang | F02D 13/04 123/321 |
| 2018/0202326 | A1 | 7/2018 | Cecur | |

* cited by examiner

ROCKER ARM ASSEMBLY HAVING A HYDRAULIC LASH ADJUSTER

TECHNICAL FIELD

The present disclosure relates generally to rocker arm assemblies and, in particular, to rocker arm assemblies that have a hydraulic lash adjuster.

BACKGROUND

Internal combustion engines (e.g., diesel engines, gasoline engines, gaseous fuel-powered engines, and other engines known in the art) typically include a valve train. The valve train includes intake and exhaust valves in a combustion chamber and a mechanism to cause the valves to open and close. The valve train may include a rocker arm assembly having a pushrod that is engaged by a cam lobe positioned on a rotating cam shaft such that the rotation of the cam shaft causes the pushrod to engage a rocker arm and pivot the rocker arm to open and close the intake and exhaust valves. In some instances, lash adjustment features are provided on the valve train to eliminate lash (i.e., the mechanical clearance between valve train components). One type of lash adjustment feature is a hydraulic tappet or a hydraulic lash adjuster ("HLA"), which typically includes mechanical components that cooperate to expand under hydraulic pressure to eliminate lash during one portion of a valve cycle, typically when the valve train is under low load or unloaded, and then assume a hydraulically "locked" or incompressible state during another portion of the valve cycle, typically when the valve train is under high load.

An HLA has been used in a front end of a rocker arm to abut an engine valve, in which the HLA includes a hydraulic lash adjusting arrangement configured to automatically compensate for lash in an engine valve train and a lost motion arrangement configured to inhibit motion (induced in the valvetrain in response to a lift profile of a rotating cam) from being transferred to the engine valve. For example, U.S. Pat. No. 10,294,828, which issued on May 21, 2019, describes an HLA that includes a first plunger that can be expanded by a first biasing means so as to take up slack in the valve train assembly. The HLA also includes a second plunger that allows for the valve to open based on the second plunger's position in relation to the first plunger, but prevents the valve from opening based on another position of the second plunger relative to the first plunger.

An HLA has been placed on a front end of a rocker arm to abut an engine valve, in which an adjustment screw was used to adjust the amount of lift of the engine valve during opening and closing of the engine valve. For example, U.S. Pat. No. 7,493,879, to Fujii et al., which issued on Feb. 24, 2009, describes a rocker arm that includes a receiving member for receiving an HLA, and a restricting part that restricts movement of the receiving member when the engine valve is in a closed state. An adjustment screw is used to adjust the clearance between the restricting part and the receiving member such that there is no variation in the amount of lift of the engine valve even if there are production errors, assembly errors, etc.

SUMMARY

An exemplary embodiment of retrofitted rocker arm assembly for an engine includes a rocker shaft, a rocker arm, and a pushrod. The rocker arm is connected to the rocker shaft such that the rocker arm can pivot relative to the rocker shaft. The rocker arm has a first end, a second end, and a first oil passage. The pushrod has a top end connected to the second end of the rocker arm, and a bottom end configured for engaging a camshaft of the engine. The top end of the pushrod has a hydraulic lash adjuster that includes a housing, a first body member, a second body member, a third body member, a check valve, and a biasing member. The first body member is disposed within the housing such that a first radial clearance exists between an outer surface of the first body member and an inner surface of the housing. The first body member also includes a second oil passage that is in fluid communication with the first oil passage of the rocker arm. The second body member is disposed within the housing such that a second radial clearance exists between an outer surface of the second body member and the inner surface of the housing. The second body member includes a first bore and an opening that is in fluid communication with the second oil passage of the first body member. The third body member is disposed within the first bore of the second body member such that a third radial clearance exists between an outer surface of the third body member and an inner surface of the first bore of the second body member. The third radial clearance is less than both the first radial clearance and the second radial clearance. The third body member has a second bore. The check valve is configured to allow oil to flow through the opening of the second body member when the check valve is in an open position and configured to prevent the flow of oil through the opening when the check valve is in a closed position. The biasing member is disposed in the second bore of the third body member.

Another exemplary embodiment of a retrofitted rocker arm assembly includes a rocker shaft, a rocker arm, and a pushrod. The rocker arm is connected to the rocker shaft such that the rocker arm can pivot relative to the rocker shaft. The rocker arm has a first end, a second end, and a first oil passage. The first end of the rocker arm has a hydraulic lash adjuster that includes a housing, a first body member, a second body member, a check valve, and a biasing member. The housing has a first opening that is in fluid communication with the first oil passage. The first body member is disposed in the housing and includes a first bore. The second body member is disposed in the housing such that a first radial clearance exists between an outer surface of the second body member and the inner surface of the housing. The second body member includes a second bore and a second opening that is in fluid communication with the first opening of the housing. The first body member is disposed within the second bore of the second body member such that a second radial clearance exists between an inner surface of the second body member and an outer surface of the first body member. The second radial clearance is less than the first radial clearance. The check valve is configured to allow oil to flow through the second opening of the second body member when the check valve is in an open position and configured to prevent the flow of oil through the second opening when the check valve is in the closed position. The biasing member is disposed in the first bore of the first body member. The pushrod has a top end and a bottom end, in which the top end is connected to the second end of the rocker arm and the bottom end is configured for engaging a camshaft of an engine.

An exemplary method of retrofitting a rocker arm assembly for an engine includes removing a first rocker arm assembly from the engine such that a camshaft of the engine remains in the engine. The method also includes providing a second rocker arm assembly that includes a rocker shaft, a rocker arm, a pushrod, and a hydraulic lash adjuster. The rocker arm is connected to the rocker shaft such that the rocker arm can pivot relative to the rocker shaft. The rocker arm has a first end, a second end, and a first oil passage. The pushrod has a top end and a bottom end, in which the top end is connected to the second end of the rocker arm and the bottom end is configured for engaging a camshaft of the engine. The hydraulic lash adjuster includes a housing, a first body member, a second body member, a check valve, and a biasing member. The first body member is disposed in the housing such that a first radial clearance exists between an outer surface of the first body member and an inner surface of the housing. The first body member has a first bore and an opening in fluid communication with the first oil passage of the rocker arm. The second body member is disposed in the first bore of the first body member such that a second radial clearance exists between the inner surface of the first bore of the first body member and an outer surface of the second body member. The second radial clearance is less than the first radial clearance. The check valve is configured to allow oil to flow through the opening of the first body member when the check valve is in an open position and configured to prevent the flow of oil through the opening when the check valve is in the closed position. The biasing member is disposed in a second bore of the second body member. The method further includes inserting the second rocker arm assembly into the engine such that the bottom end of the pushrod engages the camshaft of the engine and the front end of the rocker arm engages a valve assembly of the engine.

DETAILED DESCRIPTION

While the present disclosure describes certain embodiments of a rocker arm assembly used in a valve actuation system for an internal combustion engine, the present disclosure is to be considered exemplary and is not intended to be limited to the disclosed embodiments. Also, certain elements or features of embodiments disclosed herein are not limited to a particular embodiment, but instead apply to all embodiments of the present disclosure.

The term "about" as used herein, means approximately, in the region of, roughly, or around. When the term "about" is used in conjunction with a numerical value or range, it modifies that value or range by extending the boundaries above and below the numerical values set forth. In general, the term "about" is used herein to modify a numerical value above and below the stated value by 10%.

The present application discloses rocker arm assemblies that include hydraulic lash adjusters ("HLAs") that compensate for lash in the valvetrain of an engine. In some embodiments, the rocker arm assemblies include an HLA in a pushrod such that the HLA engages the rear end of a rocker arm. In these embodiments, the HLA may have a housing and three body members that move relative to the housing to compensate for lash in the valvetrain. In other embodiments, the rocker arm assemblies include an HLA in a front end of a rocker arm such that the HLA engages a valve assembly. In these embodiments, the HLA may have a housing and two body members that move relative to the housing to compensate for lash in the valvetrain. In any of the above embodiments, the radial clearances of the body members allow for the rocker arm assembly and HLA to be easily retrofitted into an engine that did not previously have an HLA in the rocker assembly without needing to replace the camshaft of the engine.

Figure 1:
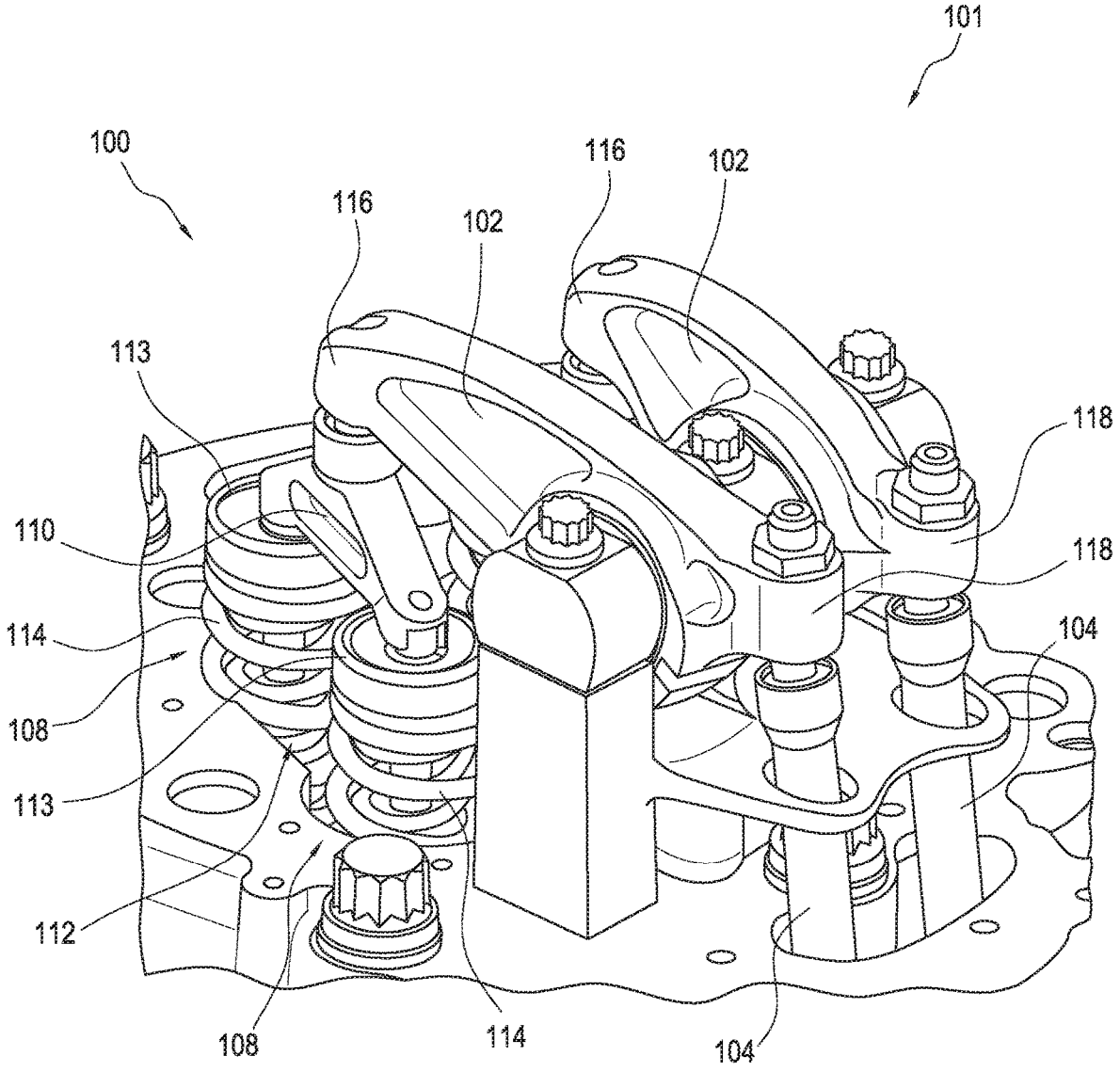
FIG. 1 is a perspective view of a rocker arm assembly for an internal combustion engine.

FIG. 1 illustrates an exemplary embodiment of a rocker arm assembly 100 for an engine 101. The rocker arm assembly 100 has one or more rocker arms 102, a pushrod 104 connected to the rocker arm 102, and a rocker shaft (see, e.g., rocker shaft 324 in FIGS. 3, 8, and 10). The rocker arms 102 include a bore (see, e.g., bore 320 in FIGS. 3, 8, and 10) such that the rocker arms 102 can be pivotally mounted on the rocker shaft. In certain embodiments, a bearing (see, e.g., bearing 326 in FIGS. 3, 8, and 10) is positioned in the bore 320 between the rocker arm 102 and the rocker shaft to allow for movement of the rocker arm 102 about the rocker shaft. The rocker arm 102 may also include a first end 116, second end 118, and one or more oil passages (see, e.g., oil passages 322, 323 in FIGS. 3, 8, and 10) extending from the bore to the first end 116 and/or the second end 118. The oil passages are in fluid communication with a longitudinally extending oil passage (e.g., oil passage 334 in FIGS. 3, 8, and 10) of the rocker shaft such that oil pumped from an oil pump (not shown) of the engine 101 moves through the rocker shaft and into the first end 116 and/or second end 118 of the rocker arm 102. The first end 116 of the rocker arm 102 is connected to valve assemblies 108 of a combustion chamber (not shown), and the second end 118 of the rocker arm 108 is connected to a pushrod 104.

In the illustrated embodiment, the valve assemblies 108 include a valve bridge 110 that connects two valve assemblies 108 together such that the two valve assemblies are caused to open and close simultaneously due to engagement between the first end 116 of the rocker arm 102 and the valve bridge 110. Each valve assembly 108 includes a valve retainer 113 that is attached to a valve spring 114 that biases the valve 112 upward into a normally-closed position.

Figure 2:
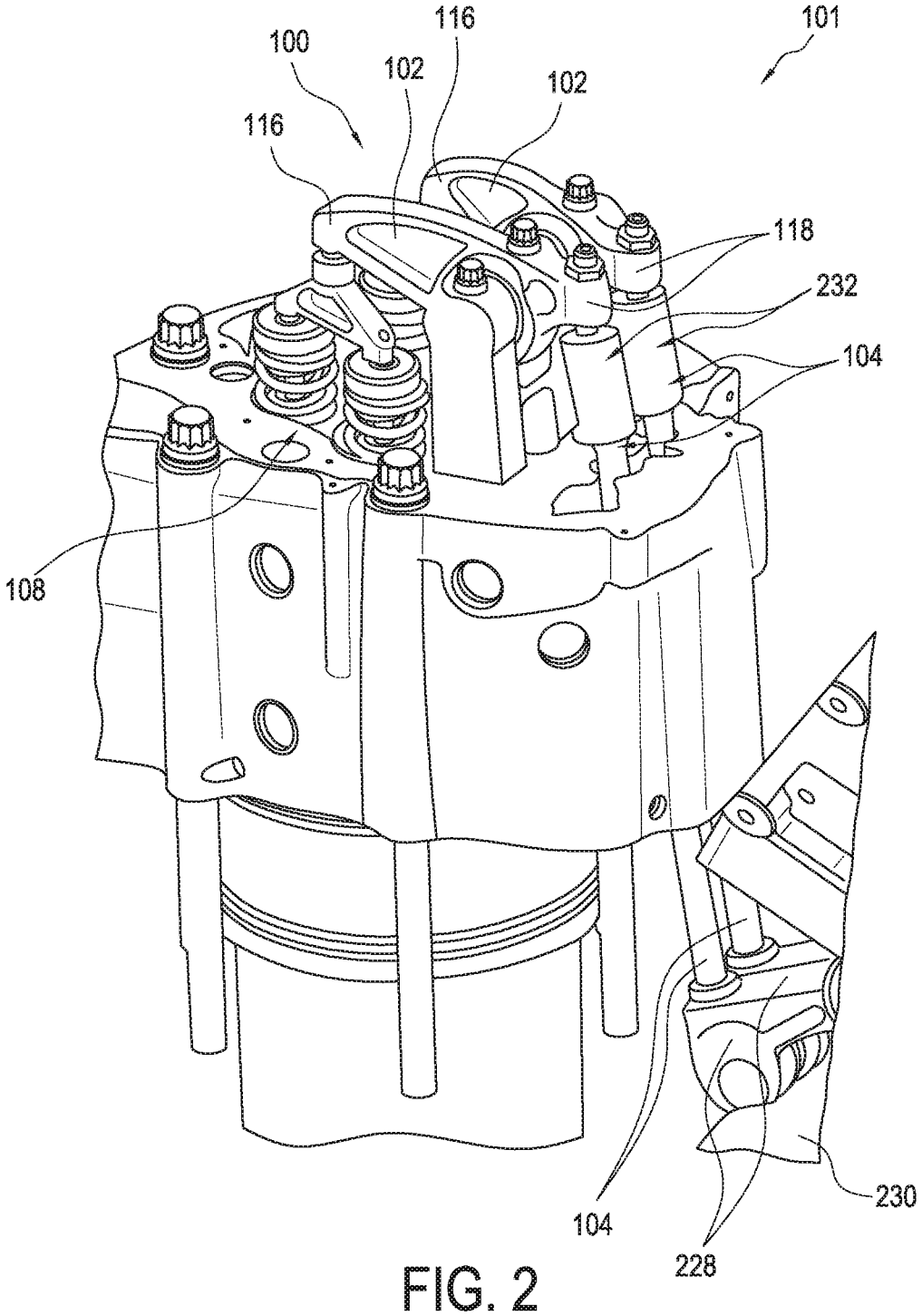
FIG. 2 is a perspective view of an exemplary embodiment of a rocker arm assembly for an internal combustion engine, in which a pushrod of the rocker arm assembly includes a hydraulic lash adjuster.
Figure 5:
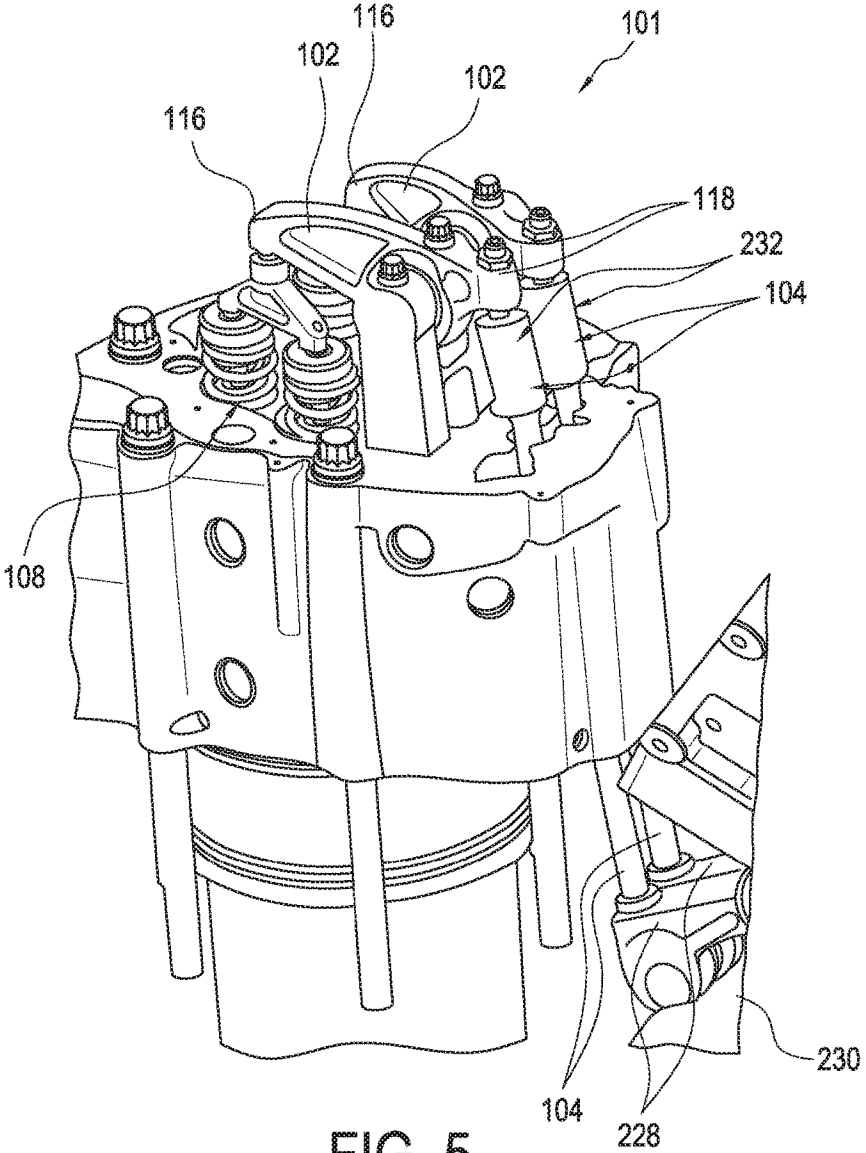
FIG. 5 is a perspective view of another exemplary embodiment of a rocker arm assembly for an internal combustion engine, in which a pushrod of the rocker arm assembly includes a hydraulic lash adjuster.

Referring to FIGS. 2 and 5, the pushrods 104 of the rocker arm assembly 100 have a cam follower 228 that are configured to engage with a camshaft 230 such that the pushrod 104 causes the rocker arm 102 to move between a first position in which the valve 112 of the valve assembly 108 is closed, and a second position in which the valve 112 is open.

Figure 4:
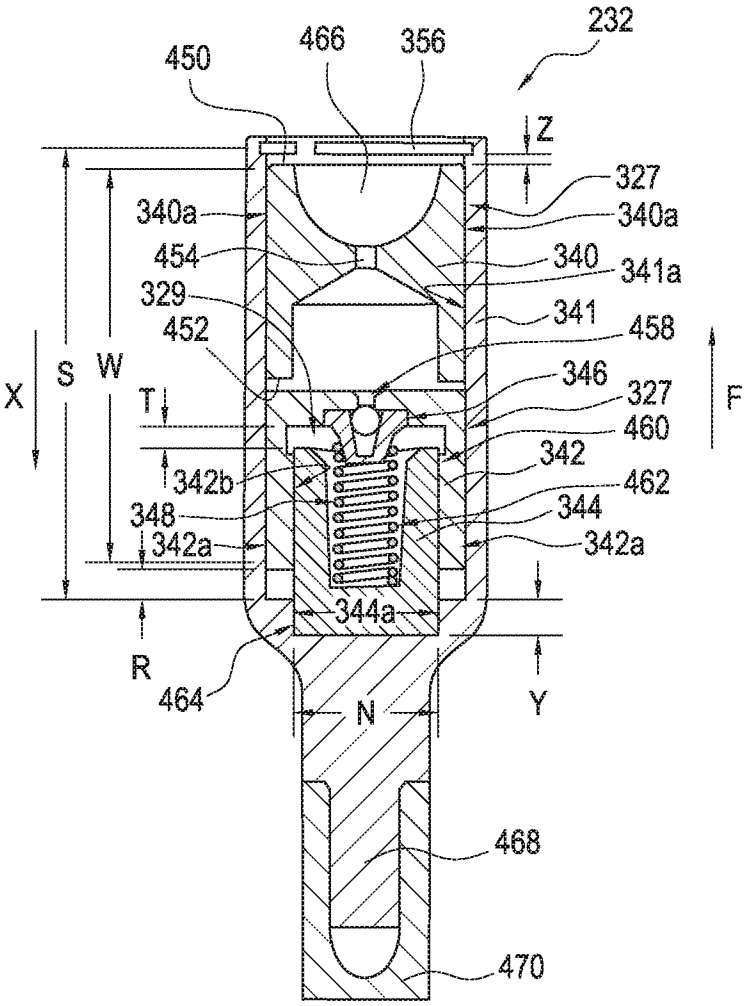
FIG. 4 is a cross-sectional view of the hydraulic lash adjuster of FIG. 3.
Figure 3:
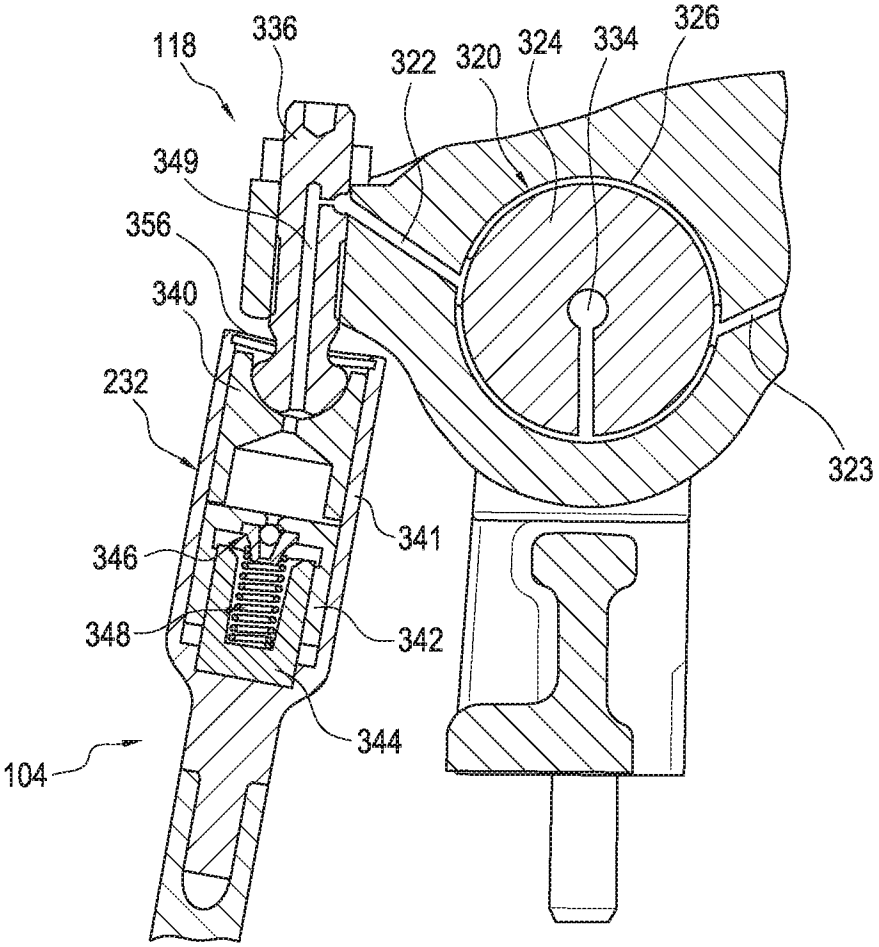
FIG. 3 is a partial cross-sectional view of the rocker arm assembly of FIG. 2 that includes an exemplary embodiment of a hydraulic lash adjuster.

Referring to FIGS. 2-4, an exemplary embodiment of a rocker arm assembly 100 includes one or more rocker arms 102, a pushrod 104 connected to the rocker arm 102, a hydraulic lash adjuster ("HLA") 232 disposed in the pushrod 104, and a rocker shaft 324. Referring to FIG. 3, the rocker arms 102 include a bore 320 such that the rocker arms 102 can be pivotally mounted on the rocker shaft 324. In certain embodiments, a bearing 326 is positioned in the bore 320 between the rocker arm 102 and the rocker shaft to allow for movement of the rocker arm 102 about the rocker shaft. The rocker arm 102 also includes a first end 116, second end 118, and one or more oil passages 322, 323 extending from the bore 320 to the first end 116 and/or the second end 118. The oil passages 322, 323 are in fluid communication with a longitudinally extending oil passage 334 of the rocker shaft 324 such that oil pumped from an oil pump (not shown) of the engine 101 moves through the rocker shaft 324 and into the first end 116 and/or second end 118 of the rocker arm 102. The first end 116 of the rocker arm 102 is connected to valve assemblies 108 of a combustion chamber (not shown), and the second end 118 of the rocker arm 108 is connected to a pushrod 104.

In the illustrated embodiment, the HLA 232 is disposed in a top portion of the pushrod 104 such that the HLA 232 attaches the pushrod 104 to the second end 118 of the rocker arm 102. For example, the second end 118 of the rocker arm 102 can include a fastener 336 (e.g., a set screw) that is configured to attach to the HLA 232. The second end 118 of the rocker arm 102 has an oil passage 349 that is in fluid communication with the oil passage 323 of the rocker arm 102 such that oil can be moved from an oil pump and into the HLA 232 through the rocker arm 102. In some embodiments, at least a portion of the oil passage 349 is located in the fastener 336. The HLA 232 is configured to prevent the rocker arm 102 and/or the pushrod 104 from becoming worn or damaged due to clearances caused by engagement between the rocker arm 102 and the pushrod 104 during use of the engine.

Referring to FIGS. 3 and 4, the HLA 232 includes a housing 341, a first body member 340 disposed in the housing 341, a second body member 342 disposed in the housing 341, a third body member 344 disposed in the housing 341, a check valve 346, and a biasing member 348.

In certain embodiments, the first body member 340 includes a connection element 466 for operatively connecting to the fastener 336 of the rocker arm 102. In the illustrated embodiment, the fastener 336 includes a pivoting member (e.g., a ball-shaped member) that is attached to the connection element 466 by a compression fit such that the pivoting member can pivot about the first body member 340. The first body member 340 can, however, attach to the fastener 336 by any suitable means, such as, for example, by a snap-fit connection, a friction-fit connection, etc. The HLA 232, however, can attach to the rocker arm 102 by any other suitable means. In the illustrated embodiment, the housing 341 includes an attachment element 468 that connects to an arm 470 of the pushrod 104. The housing 341 can attach to the arm 470 by, for example, a snap-fit connection, a friction-fit connection, a threaded connection, etc.

Each of the body members 340, 342, 344 is movable relative to the housing 341. A bore 464 of the housing 341 has a depth Y and an inner diameter N. In certain embodiments the depth Y is between about 5 mm and about 10 mm, such as between about 5 mm and about 8 mm. In some embodiments, the diameter N is between about 5 mm and about 6 mm less than an outer diameter of the first body member 340. The first body member 340 is positioned within the housing 341 such that a radial clearance of between about 40 microns and about 120 microns exists between the outer surface 3340*a* of the first body member 340 and the inner surface of the housing 341*a*, such as a radial clearance of between about 60 microns and about 80 microns. The second body member 342 is positioned within the housing 341 such that a radial clearance of between about 40 microns and about 80 microns exists between the outer surface 342*a* of the second body member 342 and the inner surface 341*a* of the housing 341, such as a radial clearance of between about 40 microns and about 60 microns. The third body member 344 is positioned within a bore 460 of the second body member 342 such that a radial clearance of between about 10 microns and about 30 microns exists between an inner surface 342*b* of the bore 460 of the second body member 342 and the outer surface 344*a* of the third body member 344, such as a radial clearance of between about 12 microns and about 20 microns. These radial clearances allow the body members 340, 342, 344 to move relative to each other and the housing 341. The body members 340, 342, 344 can be made of, for example, hardened steel, carbonitrided steel, nitride steel, or any other suitable material. In some embodiments, each of the body members 340, 342, 344 is made of the same material(s). In other embodiments, one or more of the body members 340, 342, 344 can be made of different material(s).

The first body member 340 has a top surface 450, a bottom surface 452, and an oil passage 454 extending between the top surface 450 and the bottom surface 452. The oil passage 454 is in fluid communication with the oil passage 322 of the rocker arm 102 via the oil passage 349 such that oil can be pumped through the first body member 340 of the HLA 232. The second body member 342 includes an opening 458 that is in fluid communication with the oil passage 454, and the check valve 346 is positioned in the opening 458 to regulate the flow of oil from the oil passage 454 through the opening 458. The bore 460 of the second body member 342 receives a portion of the third body member 344. The biasing member 348 is positioned in a bore 462 of the third body member 344 and is configured to provide a force to the second body member 342 to move the second body member 342 relative to the housing 341 in the direction F, which then provides a force to the first body member 340 to move the first body member 340 relative to the housing 341 in the direction F. The biasing member 348 can be, for example, a spring. A portion of the third body member 344 is disposed in the bore 464 of the housing 341.

In the illustrated embodiment, the entire first body member 340 is disposed in the housing 341, and the top portion of the housing 341 includes a retaining clip 356 that prevents the first body member 340 from exiting the housing 341. When the bottom surface of the first body member 340 is abutting the top surface of the second body member 342, the first and second body members 340, 342 have a combined height W, which can be between about 35 mm and about 45 mm, such as about 40.3 mm. In addition, the interior of the housing 341 has a height S (not including the bore 464) that is greater than the combined height W of the first and second body portions 340, 342. The height S can be between about 40 mm and about 50 mm, such as about 45.8 mm.

Accordingly, when the HLA 232 is in its normal position (e.g., when no oil is in the HLA), a clearance Z between the retaining clip 356 of the housing 341 and the first body member 340 is between about 1.5 mm and about 4 mm, such as about 1.5 mm. In addition, a clearance T between the second body member 342 and the third body member 344 is between about 1 mm and about 5 mm, such as about 3 mm. A clearance R between the second body member 342 and a bottom surface of the housing 341 is between about 2 mm and about 6 mm, such as about 4 mm. The clearances Z, T, R between the body members 340, 342, 344 and the depth Y of the bore 464 allow the body members 340, 342, 344 to move relative to each other and the housing 341.

During the valve cycle of the engine 101, oil is provided to the HLA 232 to eliminate lash during one portion of the valve cycle, typically when the valvetrain is under low load or unloaded, and then to assume a hydraulically "locked" or incompressible state during another portion of the valve cycle, typically when the valvetrain is under high load. Referring to FIGS. 4 and 5, oil moves through the oil passages 322, 349 and into the housing 341 of the HLA 232. The oil moves through the passage 454 of the first body member 340, as well as around the exterior of the first body member 340, which allows the first body member 340 to move relative to the housing 341. The oil also moves around the second body member 342 and through the opening 458 of the second body member 342. When the valve train is under low load or unloaded, movement of the oil through the opening 458 causes the check valve 346 to open such that oil can move around the interior of the second body member 342, and around the interior and exterior of the third body member 344. Accordingly, oil is disposed in the depth Y of the of the bore 464 and the clearances Z, T, R between the body members 340, 342, 344.

When the valvetrain is under low load or unloaded, the three body members 340, 342, 344 can move relative to each other in both the direction X and direction F to eliminate lash. The radial clearances of the body members 340, 342, 344 allow for the body members to move easily within the housing 341 such that body members do not become worn due to scrubbing between each other. The first body member 340, the second body member 342, and the housing 341 at least partially define a first pressure area 327, and the second body member 342 and the third body member 344 at least partially define a second pressure area 329. When oil is moving through the HLA 232, the oil pressure in the first pressure area 327 can be between about 50 kPa and about 800 kPa, and the oil pressure in the second pressure area 329 can be between about 10 MPa and about 40 MPa. Once the pressure in the second pressure area 329 exceeds a threshold value, the check valve 346 moves to a closed position and the force provided by the oil pressure and the biasing member 348 causes the first and the second body members 340, 342 to move in the direction F and substantially eliminate the clearance Z between the top surface of the first body member 340 and the top portion 356 of the housing 341, thus causing the HLA 232 to assume a hydraulically "locked" or incompressible state. The oil is eventually dispensed from the HLA 232 through an outlet (not shown) such that the body members 340, 342, 344 can again move relative to the each other and the housing 341 to eliminate lash.

Figure 6:
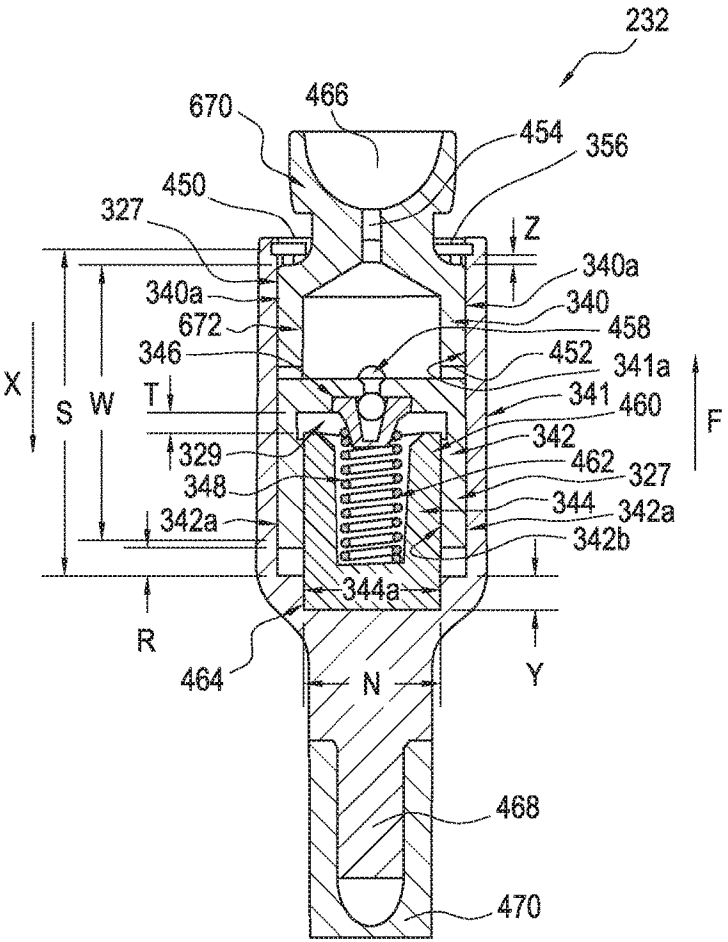
FIG. 6 is a cross-sectional view of an exemplary embodiment of a hydraulic lash adjuster for the rocker arm assembly of FIG. 5.

Referring to FIGS. 5-6, another exemplary embodiment of a rocker arm assembly 100 includes one or more rocker arms 102, a pushrod 104 connected to the rocker arm 102, a hydraulic lash adjuster ("HLA") 232 disposed in the pushrod 104, and a rocker shaft (e.g., rocker shaft 324 shown in FIG. 3). The rocker arms 102 can take any suitable form, such as, for example, any form described in the present application. The first end 116 of the rocker arm 102 is connected to valve assemblies 108 of a combustion chamber (not shown), and the second end 118 of the rocker arm 108 is connected to a pushrod 104.

In the illustrated embodiment, the HLA 232 is disposed in a top portion of the pushrod 104 such that the HLA 232 attaches the pushrod 104 to the second end 118 of the rocker arm 102. For example, the second end 118 of the rocker arm 102 can include a fastener 336 (e.g., a set screw) that is configured to attach to the HLA 232. The second end 118 of the rocker arm 102 has an oil passage (e.g., oil passage 349 shown in FIG. 3) that is in fluid communication with an oil passage (e.g., oil passage 323 shown in FIG. 3) of the rocker arm 102 such that oil can be moved from an oil pump and into the HLA 232 through the rocker arm 102. The HLA 232 is configured to prevent the rocker arm 102 and/or the pushrod 104 from becoming worn or damaged due to clearances caused by engagement between the rocker arm 102 and the pushrod 104 during use of the engine.

Referring to FIGS. 5 and 6, the HLA 232 includes a housing 341, first body member 340 disposed in the housing 341, a second body member 342 disposed in the housing 341, a third body member 344 disposed in the housing 341, a check valve 346, and a biasing member 348. Each of the body members 340, 342, 344 is movable relative to the housing 341. In the illustrated embodiment, the first body member 340 includes a first portion 670 disposed outside of the housing 341 and a second portion 672 disposed in the housing 341. In certain embodiments, the first portion 670 of the first body member 340 includes a connection element 466 for operatively connecting to the fastener 336 of the rocker arm 102. In the illustrated embodiment, the fastener 336 includes a pivoting member (e.g., a ball-shaped member) that is attached to the connection element 466 by a compression fit such that the pivoting member can pivot about the first body member 340. The first portion 670 of the first body member 340 can, however, attach to the fastener 336 by any suitable means, such as, for example, by a snap-fit connection, a friction-fit connection, etc. The HLA 232, however, can attach to the rocker arm 102 by any other suitable means. In the illustrated embodiment, the housing 341 includes an attachment element 468 that connects to an arm 470 of the pushrod 104. The housing 341 can attach to the arm 470 by, for example, a snap-fit connection, a friction-fit connection, a threaded connection, etc.

A bore 464 of the housing 341 has a depth Y and an inner diameter N. In certain embodiments the depth Y is between about 5 mm and about 10 mm, such as between about 5 mm and about 8 mm. In some embodiments, the diameter N is between about 5 mm and about 6 mm less than an outer diameter of the first body member 340. The first body member 340 is positioned within the housing 341 such that a radial clearance of between about 40 microns and about 120 microns exists between the outer surface **340*a* of the first body member 340 and the inner surface 341*a* of the housing 341, such as a radial clearance of between about 60 microns and about 80 microns. The second body member 342 is positioned within the housing 341 such that a radial clearance of between about 40 microns and about 80 microns exists between the outer surface 342*a* of the second body member 342 and the inner surface 341***a* of the housing 341, such as a radial clearance of between about 40 microns and about 60 microns. The third body member 344 is positioned within a bore 460 of the second body member 342 such that a clearance of between about 10 microns and about 30 microns exists between an inner surface 342*b* of the bore 460 of the second body member 342 and the outer surface 344*a* of the third body member 344, such as a radial clearance of between about 12 microns and about 20 microns. These radial clearances allow the body members 340, 342, 344 to move relative to each other and the housing 341. The body members 340, 342, 344 can be made of, for example, hardened steel, carbonitrided steel, nitride steel, or any other suitable material. In some embodiments, each of the body members 340, 342, 344 is made of the same material(s). In other embodiments, one or more of the body members 340, 342, 344 can be made of different material(s).

The second portion 672 of the first body member 340 has a top surface 450, a bottom surface 452, and an oil passage 454. The oil passage 454 is in fluid communication with the oil passage(s) of the rocker arm 102 such that oil can be pumped through the first body member 340 of the HLA 232. The second body member 342 includes an opening 458 that is in fluid communication with the oil passage 454, and the check valve 346 is positioned in the opening 458 to regulate the flow of oil from the oil passage 454 through the opening 458. The bore 460 of the second body member 342 receives a portion of the third body member 344. The biasing member 348 is positioned in a bore 462 of the third body member 344 and is configured to provide a force to the second body member 342 to move the second body member 342 relative to the housing 341 in the direction F, which then provides a force to the first body member 340 to move the first body member 340 relative to the housing 341 in the direction F. The biasing member 348 can be, for example, a spring. A portion of the third body member 344 is disposed in the bore 464 of the housing 341.

In the illustrated embodiment, the second portion 672 of the first body member 340 is disposed in the housing 341 and the first portion 670 of the first body member 340 is disposed outside of the housing 341. The housing 341 includes a retaining clip 356 that prevents the first body member 340 of the HLA 232 from exiting the top portion of the housing 341. When the bottom surface of the first body member 340 is abutting the top surface of the second body member 342, the first and second body members 340, 342 have a combined height W, which can be between about 35 mm and about 45 mm, such as about 40.3 mm. In addition, the interior of the housing 341 has a height S (not including the bore 464) that is greater than the combined height W of the first and second body portions 340, 342. The height S can be between about 40 mm and about 50 mm, such as about 45.8 mm.

Accordingly, when the HLA 232 is in its normal position (e.g., when no oil is in the HLA), a clearance Z between the retaining clip 356 of the housing 341 and the top surface 450 of the second portion 672 of the first body member 340 is between about 1.5 mm and about 4 mm, such as about 1.5 mm. In addition, a clearance T between the second body member 342 and the third body member 344 is between about 1 mm and about 5 mm, such as about 3 mm. A clearance R between the second body member 342 and a bottom surface of the housing 341 is between about 2 mm and about 6 mm, such as about 4 mm. The clearances Z, T, R between the body members 340, 342, 344 and the depth Y of the bore 464 allow the body members 340, 342, 344 to move relative to each other and the housing 341.

During the valve cycle of the engine 101, oil is provided to the HLA 232 to eliminate lash during one portion of the valve cycle, typically when the valvetrain is under low load or unloaded, and then to assume a hydraulically "locked" or incompressible state during another portion of the valve cycle, typically when the valvetrain is under high load. Referring to FIG. 6, the oil moves through the passage 454 of the first body member 340, as well as around the exterior of the second portion 672 of the first body member 340, which allows the first body member 340 to move relative to the housing 341. The oil also moves around the second body member 342 and through the opening 458 of the second body member 342. When the valve train is under low load or unloaded, movement of the oil through the opening 458 causes the check valve 346 to open such that oil can move around the interior of the second body member 342, and around the interior and exterior of the third body member 344. Accordingly, oil is disposed in the depth Y of the of the bore 464 and the clearances Z, T, R between the body members 340, 342, 344.

When the valvetrain is under low load or unloaded, the three body members 340, 342, 344 can move relative to each other in both the direction X and direction F to eliminate lash. The radial clearances of the body members 340, 342, 344 allow for the body members to move easily within the housing 341 such that body members do not become worn due to scrubbing between each other. The first body member 340, the second body member 342, and the housing 341 at least partially define a first pressure area 327, and the second body member 342 and the third body member 344 at least partially define a second pressure area 329. When oil is moving through the HLA 232, the oil pressure in the first pressure area 327 can be between about 50 kPa and about 800 kPa, and the oil pressure in the second pressure area 329 can be between about 10 MPa and about 40 MPa. Once the pressure in the second pressure area 329 exceeds a threshold value, the check valve 346 moves to a closed position and the force provided by the oil pressure and the biasing member 348 causes the first and the second body members 340, 342 to move in the direction F and substantially eliminate the clearance Z between the top surface of the first body member 340 and the top portion 356 of the housing 341, thus causing the HLA 232 to assume a hydraulically "locked" or incompressible state. The oil is eventually dispensed from the HLA 232 through an outlet (not shown) such that the body members 340, 342, 344 can again move relative to the each other and the housing 341 to eliminate lash.

Figure 7:
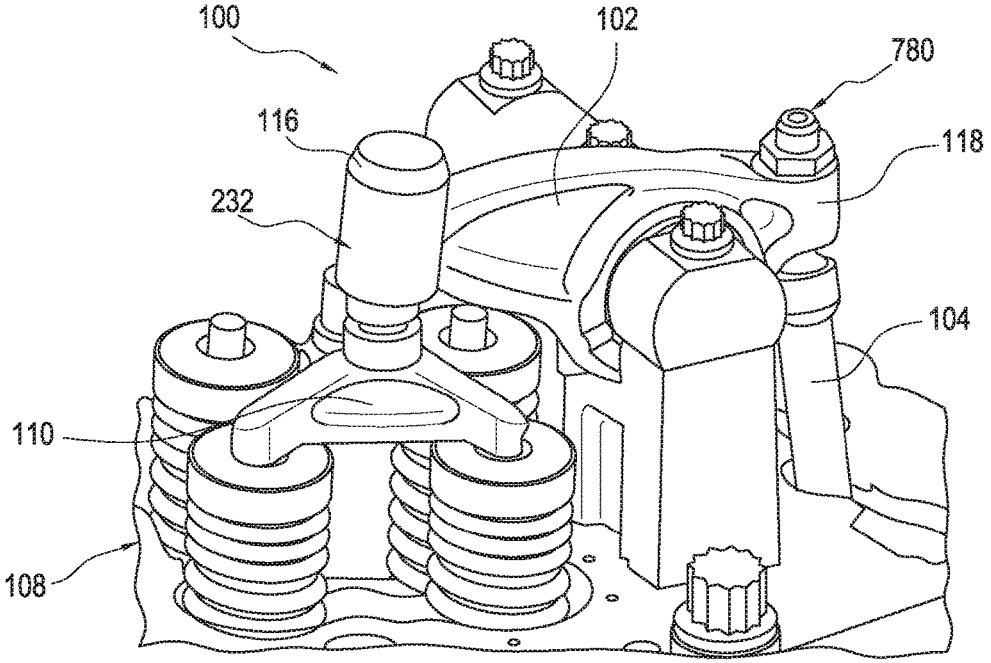
FIG. 7 is a perspective view of another exemplary embodiment of a rocker arm assembly for an internal combustion engine, in which a first end of a rocker arm includes a hydraulic lash adjuster and the rear end of the rocker arm includes an adjustment member.
Figure 8:
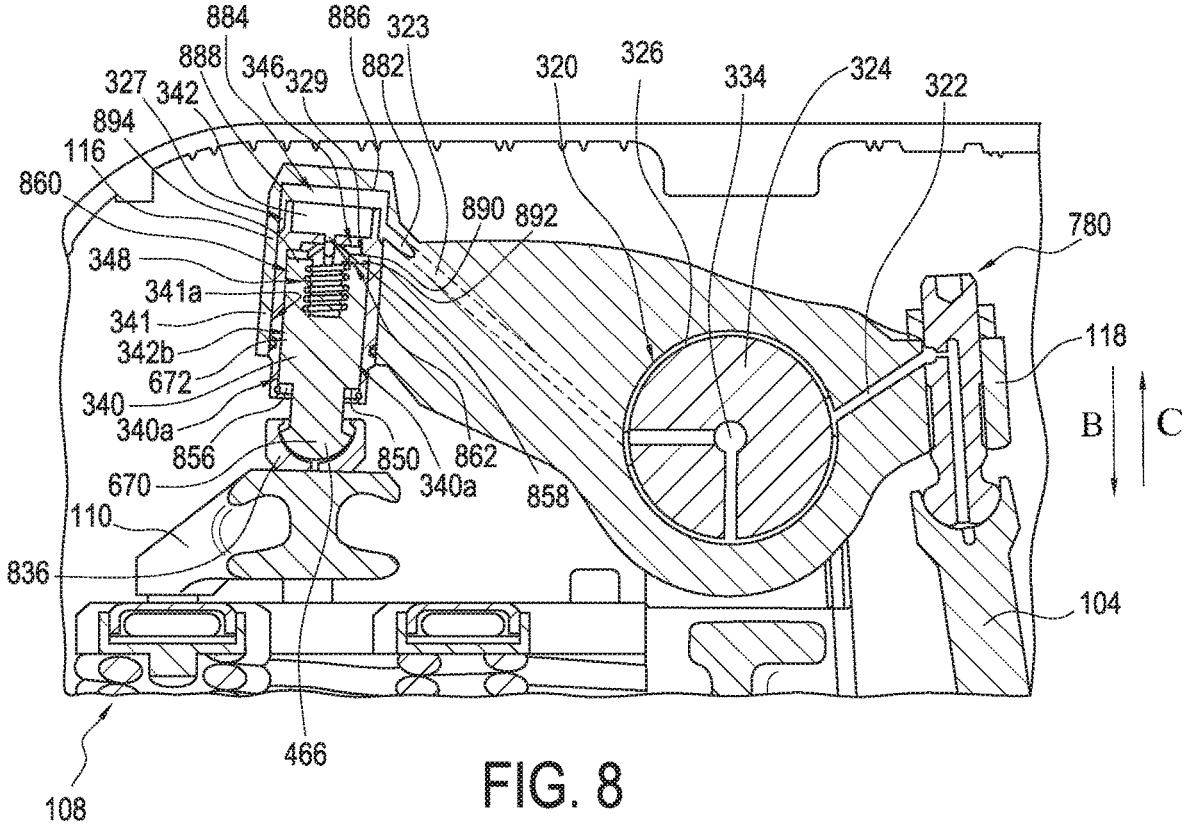
FIG. 8 is a cross-sectional view of the rocker arm assembly of FIG. 7 that includes an exemplary embodiment of a hydraulic lash adjuster.

Referring to FIGS. 7-8, another exemplary embodiment of a rocker arm assembly 100 includes one or more rocker arms 102, a pushrod 104 connected to the rocker arm 102, a hydraulic lash adjuster ("HLA") 232, an adjustment fastener 780, and a rocker shaft 324. The rocker arms 102 can take any suitable form, such as, for example, any form described in the present application. Referring to FIG. 8, the rocker arms 102 include a bore 320 such that the rocker arms 102 can be pivotally mounted on the rocker shaft 324. In certain embodiments, a bearing 326 is positioned in the bore 320 between the rocker arm 102 and the rocker shaft to allow for movement of the rocker arm 102 about the rocker shaft. The rocker arm 102 also includes a first end 116, second end 118, and one or more oil passages 322, 323 extending from the bore 320 to the first end 116 and/or the second end 118. The oil passages 322, 323 are in fluid communication with a longitudinally extending oil passage 334 of the rocker shaft 324 such that oil pumped from an oil pump (not shown) of the engine 101 moves through the rocker shaft 324 and into the first end 116 and/or second end 118 of the rocker arm 102. The first end 116 of the rocker arm 102 is connected to valve assemblies 108 of a combustion chamber (not shown), and the second end 118 of the rocker arm 108 is connected to a pushrod 104.

The HLA 232 is disposed in first end 116 of the rocker arm 102 such that the HLA 232 attaches the rocker arm 102 to the valve assembly 108. In the illustrated embodiment, the HLA 232 attaches the rocker arm 102 to the valve bridge 110 of the valve assembly 108. The second end 118 of the rocker arm 102 has an oil passage 323 that is in fluid communication with an opening 882 of the HLA 232 such that oil can be moved from an oil pump and into the HLA 232. The HLA 232 is configured to compensate for both mechanical wear and thermal changes in the valvetrain to ensure that the valves of the valve assembly 108 seal against the valve seats.

Referring to FIG. 8, the HLA 232 includes a housing 341, first body member 340 disposed in the housing 341, a second body member 342 disposed in the housing 341, a check valve 346, and a biasing member 348. Each of the body members 340, 342 is movable relative to the housing 341. The biasing member 348 is positioned in a bore 862 of the first body member 340 and is configured to provide a force to the second body member 342 to move the second body member 342 relative to the housing 341 toward the top surface 886 of the housing 341. The biasing member 348 can be, for example, a spring. The second body member 842 includes an opening 858 that is in fluid communication with the oil passage 323 of the rocker arm 102, and the check valve 346 is positioned in the opening 858 to regulate the flow of oil through the opening 858.

The second body member 342 is positioned within the housing 341 such that a radial clearance of between about 40 microns and about 120 microns exists between the outer surface 342*a* of the second body member 342 and the inner surface of the housing 341*a*, such as a radial clearance of between about 40 microns and about 80 microns. The second body member 340 is positioned within a bore 860 of the second body member 342 such that a radial clearance of between about 10 microns and about 30 microns exists between the inner surface 342*b* of the second body member 342 and the outer surface 340*a* of the first body member 340, such as a radial clearance of between about 12 microns and about 20 microns. These radial clearances allow the body members 340, 342 to move relative to each other and the housing 341. The body members 340, 342 can be made of, for example, hardened steel, carbonitrided steel, nitride steel, or any other suitable material.

In the illustrated embodiment, the first body member 340 includes a first portion 670 disposed outside of the housing 341 and a second portion 672 disposed in the housing 341. In certain embodiments, the first portion 670 of the first body member 340 includes a connection element 466 for attaching to a fastener 836 of the valve assembly 108. In the illustrated embodiment, the connection element 466 includes a pivoting member (e.g., a ball-shaped member) that is attached to the fastener 836 by a compression fit such that the pivoting member can pivot about the fastener 836. The first portion 670 of the first body member 340 can, however, attach to the fastener 836 by any suitable means, such as, for example, a snap-fit connection, a friction fit connection, etc. The HLA 232 can, however, attach to the valve assembly 108 by any other suitable means. While the illustrated embodiment of the HLA 232 is shown as having two body members, it should be understood that the HLA 232 can include any suitable number of body members and can take the form of any suitable hydraulic lash adjuster design.

The second body member 342 is disposed in the housing 341 such that a clearance 884 exists between the top surface 886 of the housing 341 and the top surface 888 of the second body member 342. The second body member 342 includes a bore 860 for receiving the second portion 670 of the first body member 340. The second portion 672 of the first body member 340 is disposed in the housing 341 such that a clearance 892 exists between top surface 894 of the first body member 340 and a surface 890 of the second body member 342. In certain embodiments, the clearance 892 between the first body member 340 and the second body member 342 can be between about 1 mm and about 5 mm. The housing 341 can include a retaining clip 856 that prevents the first body member 340 from exiting the HLA 232 at the bottom portion of the housing 341. A clearance 896 may exist between the bottom portion 856 of the housing 341 and the bottom surface 850 of the second portion 672 of the first body member 340. The clearances 884, 892, 896 allow the first and second body members 340, 342 to move relative to the housing 341.

The adjustment fastener 780 is configured to adjust the clearances 884, 892, 896 of the HLA 232 when the HLA is in the normal operating position (e.g., when no oil is in the HLA), which allows the rocker arm assembly 102 to be retrofitted onto an engine that did not previously include a HLA 232 in the first end of the rocker arm 102. That is, each engine may require an HLA 232 to have different clearances for a rocker arm assembly having the HLA to be retrofitted into the engine, and thus being able to adjust the clearances 884, 892, 896 of the HLA 232 allows the retrofitted rocker arm assembly 100 to be used with engines requiring various sizes of clearance.

In the illustrated embodiment, the adjustment fastener 780 is disposed on the second end 118 of the rocker arm 102 that is movable in the direction B to make the size of the clearances 884, 892, 896 smaller; and that is movable in the direction C to make the size of the clearances 884, 892, 896 greater. That is, movement of the adjustment fastener 780 in the direction B provides a compression force on the rocker arm 102 that causes the rocker arm 102 (and, consequently, the housing 341 of the HLA 232) to move in the direction B, which reduces the size of the clearances 884, 892, 896. Movement of the adjustment fastener 780 in the direction C allows the rocker arm 102 to move in the direction C (and, consequently, the housing 341 of the HLA 232 to move in the direction C), which increases the size of the clearances 884, 892, 896. In certain embodiments, the clearance 884 may be substantially fixed due to the engagement between the top surface 888 of the second body 342 and the housing 341, and/or the clearance 896 may be substantially fixed due to the engagement between the bottom surface 850 of the first body member and the retaining clip 856. In these embodiments, the adjustment fastener 780 may be used to adjust the clearance 892 alone or in combination with one of the other clearances 884, 896 of the HLA 232.

During the valve cycle of the engine 101, oil is provided to the HLA 232 to eliminate lash during one portion of the valve cycle, typically when the valvetrain is under low load or unloaded, and then to assume a hydraulically "locked" or incompressible state during another portion of the valve cycle, typically when the valvetrain is under high load. Referring to FIG. 8, the oil moves through the opening 882 of the housing 341 such that the oil is disposed between the second body member 342 and the top surface 886 of the housing 341, as well was around the exterior of the second body member 342, which allows the second body member 342 to move relative to the housing 341. The oil also moves through the opening 858 of the first body member 340. When valve train is under low load or unloaded, movement of the oil through the opening 858 causes the check valve 346 to open such that oil is positioned between the first body member 340 and the second body member 342.

When the valvetrain is under low load or unloaded, the body members 340, 342 can move relative to each other to eliminate lash. The radial clearances of the body members 340, 342 allow for the body members to move easily within the housing 341 such that body members do not become worn due to scrubbing between each other. The second body member 340 and the housing 341 at least partially define a first pressure area 327, and the second body member 342 and the first body member 340 at least partially define a second pressure area 329. When oil is moving through the HLA 232, the oil pressure in the first pressure area 327 can be between about 50 kPa and about 800 kPa, and the oil pressure in the second pressure area 329 can be between about 10 MPa and about 40 MPa. Once the pressure in the second pressure area 329 exceeds a threshold value, the check valve 346 moves to a closed position and the force provided by the oil pressure and the biasing member 348 causes the second body member 342 to move toward the top surface 886 of the housing 341 to substantially eliminate the clearance 892, thus causing the HLA 232 to assume a hydraulically "locked" or incompressible state. The oil is eventually dispensed from the HLA 232 through an outlet (not shown) such that the body members 340, 342 can again move relative to the each other and the housing 341 to eliminate lash.

Figure 9:
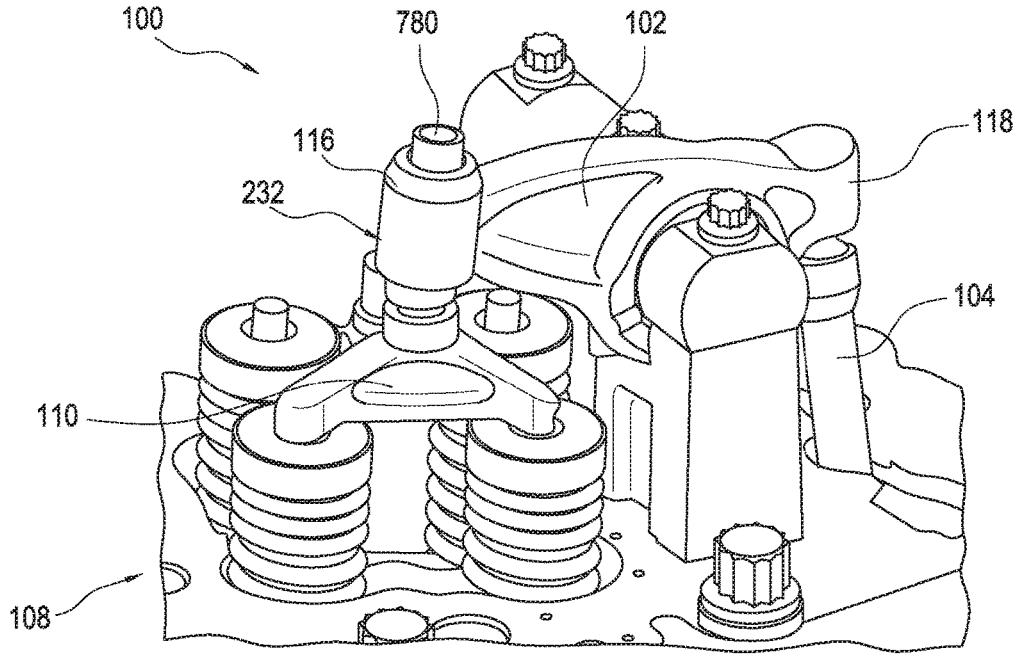
FIG. 9 is a perspective view of another exemplary embodiment of a rocker arm assembly for an internal combustion engine, in which a first end of a rocker arm includes a hydraulic lash adjuster and an adjustment member.
Figure 10:
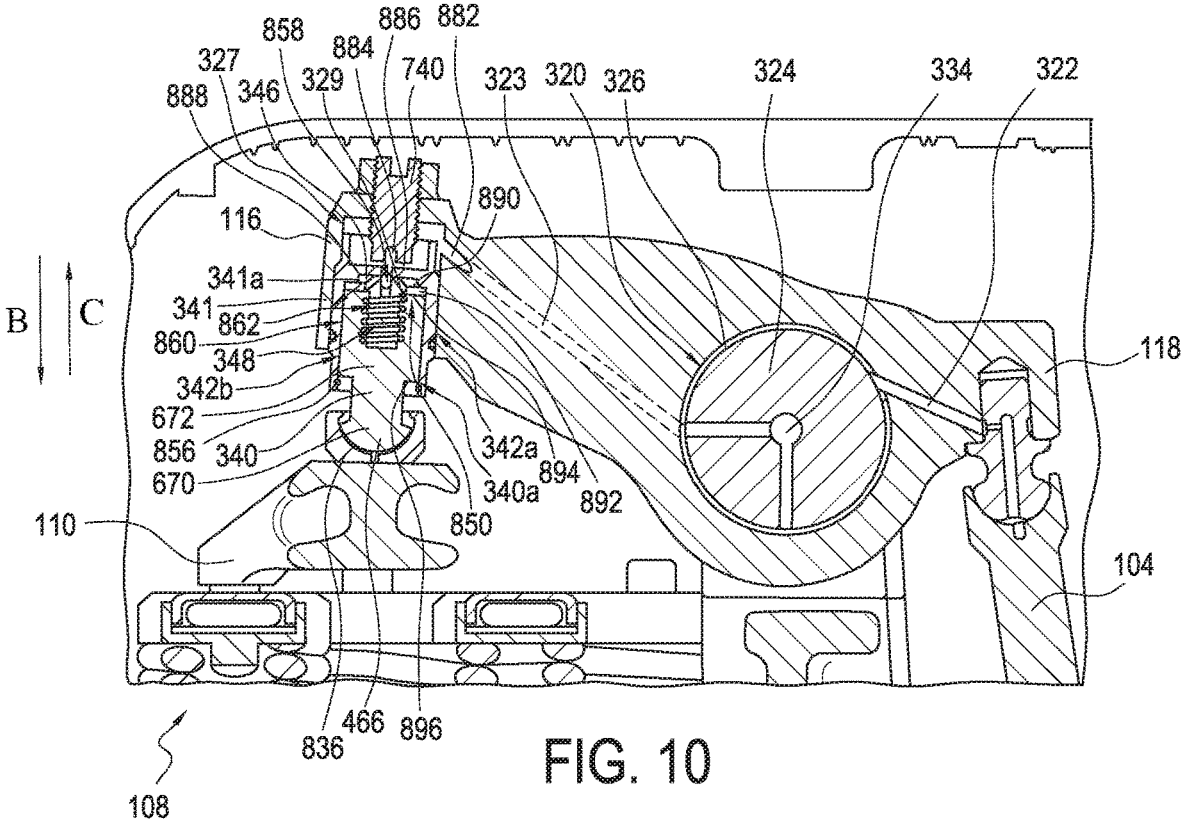
FIG. 10 is a cross-sectional view of the rocker arm assembly of FIG. 9 that includes an exemplary embodiment of a hydraulic lash adjuster.

Referring to FIGS. 9-10, another exemplary embodiment of a rocker arm assembly 100 includes one or more rocker arms 102, a pushrod 104 connected to the rocker arm 102, a hydraulic lash adjuster ("HLA") 232, an adjustment fastener 780, and a rocker shaft 324. The rocker arms 102 can take any suitable form, such as, for example, any form described in the present application. Referring to FIG. 8, the rocker arms 102 include a bore 320 such that the rocker arms 102 can be pivotally mounted on the rocker shaft 324. In certain embodiments, a bearing 326 is positioned in the bore 320 between the rocker arm 102 and the rocker shaft to allow for movement of the rocker arm 102 about the rocker shaft. The rocker arm 102 also includes a first end 116, second end 118, and one or more oil passages 322, 323 extending from the bore 320 to the first end 116 and/or the second end 118. The oil passages 322, 323 are in fluid communication with a longitudinally extending oil passage 334 of the rocker shaft 324 such that oil pumped from an oil pump (not shown) of the engine 101 moves through the rocker shaft 324 and into the first end 116 and/or second end 118 of the rocker arm 102. The first end 116 of the rocker arm 102 is connected to valve assemblies 108 of a combustion chamber (not shown), and the second end 118 of the rocker arm 108 is connected to a pushrod 104.

The HLA 232 is disposed in first end 116 of the rocker arm 102 such that the HLA 232 attaches the rocker arm 102 to the valve assembly 108. In the illustrated embodiment, the HLA 232 attaches the rocker arm 102 to the valve bridge 110 of the valve assembly 108. The second end 118 of the rocker arm 102 has an oil passage 323 that is in fluid communication with an opening 882 of the HLA 232 such that oil can be moved from an oil pump and into the HLA 232. The HLA 232 is configured to compensate for both mechanical wear and thermal changes in the valvetrain to ensure that the valves of the valve assembly 108 seal against the valve seats.

Referring to FIG. 10, the HLA 232 includes a housing 341, first body member 340 disposed in the housing 341, a second body member 342 disposed in the housing 341, a check valve 346, and a biasing member 348. Each of the body members 340, 342 is movable relative to the housing 341. The biasing member 348 is positioned in a bore 862 of the first body member 340 and is configured to provide a force to the second body member 342 to move the second body member 342 relative to the housing 341 toward the top surface 886 of the housing 341. The biasing member 348 can be, for example, a spring. The second body member 842 includes an opening 858 that is in fluid communication with the oil passage 323 of the rocker arm 102, and the check valve 346 is positioned in the opening 858 to regulate the flow of oil through the opening 858.

The second body member 342 is positioned within the housing 341 such that a radial clearance of between about 40 microns and about 120 microns exists between the outer surface 342*a* of the second body member 342 and the inner surface of the housing 341*a*, such as a radial clearance of between about 40 microns and about 80 microns. The second body member 340 is positioned within a bore 860 of the second body member 342 such that a radial clearance of between about 10 microns and about 30 microns exists between the inner surface 342*b* of the second body member 342 and the outer surface 340*a* of the first body member 340, such as a radial clearance of between about 12 microns and about 20 microns. These radial clearances allow the body members 340, 342 to move relative to each other and the housing 341. The body members 340, 342 can be made of, for example, hardened steel, carbonitrided steel, nitride steel, or any other suitable material.

In the illustrated embodiment, the first body member 340 includes a first portion 670 disposed outside of the housing 341 and a second portion 672 disposed in the housing 341. In certain embodiments, the first portion 670 of the first body member 340 includes a connection element 466 for attaching to a fastener 836 of the valve assembly 108. In the illustrated embodiment, the connection element 466 includes a pivoting member (e.g., a ball-shaped member) that is attached to the fastener 836 by a compression fit such that the pivoting member can pivot about the fastener 836. The first portion 670 of the first body member 340 can, however, attach to the fastener 836 by any suitable means, such as, for example, a snap-fit connection, a friction fit connection, etc. The HLA 232 can, however, attach to the valve assembly 108 by any other suitable means. While the illustrated embodiment of the HLA 232 is shown as having two body members, it should be understood that the HLA 232 can include any suitable number of body members and can take the form of any suitable hydraulic lash adjuster design.

The second body member 342 is disposed in the housing 341 such that a clearance 884 exists between the bottom surface 886 of the adjustment fastener 780 and the top surface 888 of the second body member 342. The second body member 342 includes a bore 860 for receiving the second portion 670 of the first body member 340. The second portion 672 of the first body member 340 is disposed in the housing 341 such that a clearance 892 exists between top surface 894 of the first body member 340 and a surface 890 of the second body member 342. In certain embodiments, the clearance 892 between the first body member 340 and the second body member 342 can be between about 1 mm and about 5 mm. The housing 341 can include a retaining clip 856 that prevents the first body member 340 from exiting the HLA 232 at the bottom portion of the housing 341. A clearance 896 may exist between the bottom portion 856 of the housing 341 and the bottom surface 850 of the second portion 672 of the first body member 340. The clearances 884, 892, 896 allow the first and second body members 340, 342 to move relative to the housing 341.

The adjustment fastener 780 is configured to adjust the clearances 884, 892, 896 of the HLA 232 when the HLA is in the normal operating position (e.g., when no oil is in the HLA), which allows the rocker arm assembly 102 to be retrofitted onto an engine that did not previously include a HLA 232 in the first end of the rocker arm 102. That is, each engine may require an HLA 232 to have different clearances for a rocker arm assembly having the HLA to be retrofitted into the engine, and thus being able to adjust the clearances 884, 892, 896 of the HLA 232 allows the retrofitted rocker arm assembly 100 to be used with engines requiring various sizes of clearance.

In the illustrated embodiment, the adjustment fastener 780 is disposed on the first end 116 of the rocker arm 102 that is movable in the direction B to make the size of the clearances 884, 892, 896 smaller; and that is movable in the direction C to make the size of the clearances 884, 892, 896 greater. That is, movement of the adjustment fastener 780 in the direction B provides a compression force on the rocker arm 102 that causes the rocker arm 102 (and, consequently, the housing 341 of the HLA 232) to move in the direction B, which reduces the size of the clearances 884, 892, 896. Movement of the adjustment fastener 780 in the direction C allows the rocker arm 102 to move in the direction C (and, consequently, the housing 341 of the HLA 232 to move in the direction C), which increases the size of the clearances 884, 892, 896. In certain embodiments, the clearance 884 may be substantially fixed due to the engagement between the top surface 888 of the second body 342 and the bottom surface 886 of the adjustment fastener 780, and/or the clearance 896 may be substantially fixed due to the engagement between the bottom surface 850 of the first body member 340 and the retaining clip 856. In these embodiments, the adjustment fastener 780 may be used to adjust the clearance 892 alone or in combination with one of the other clearances 884, 896 of the HLA 232.

During the valve cycle of the engine 101, oil is provided to the HLA 232 to eliminate lash during one portion of the valve cycle, typically when the valvetrain is under low load or unloaded, and then to assume a hydraulically "locked" or incompressible state during another portion of the valve cycle, typically when the valvetrain is under high load. Referring to FIG. 8, the oil moves through the opening 882 of the housing 341 such that the oil is disposed between the second body member 342 and the top surface 886 of the housing 341, as well was around the exterior of the second body member 342, which allows the second body member 342 to move relative to the housing 341. The oil also moves through the opening 858 of the first body member 340. When valve train is under low load or unloaded, movement of the oil through the opening 858 causes the check valve 346 to open such that oil is positioned between the first body member 340 and the second body member 342.

When the valvetrain is under low load or unloaded, the body members 340, 342 can move relative to each other to eliminate lash. The radial clearances of the body members 340, 342 allow for the body members to move easily within the housing 341 such that body members do not become worn due to scrubbing between each other. The second body member 340 and the housing 341 at least partially define a first pressure area 327, and the second body member 342 and the first body member 340 at least partially define a second pressure area 329. When oil is moving through the HLA 232, the oil pressure in the first pressure area 327 can be between about 50 kPa and about 800 kPa, and the oil pressure in the second pressure area 329 can be between about 10 MPa and about 40 MPa. Once the pressure in the second pressure area 329 exceeds a threshold value, the check valve 346 moves to a closed position and the force provided by the oil pressure and the biasing member 348 causes the second body member 342 to move toward the top surface 886 of the housing 341 to substantially eliminate the clearance 892, thus causing the HLA 232 to assume a hydraulically "locked" or incompressible state. The oil is eventually dispensed from the HLA 232 through an outlet (not shown) such that the body members 340, 342 can again move relative to the each other and the housing 341 to eliminate lash.

INDUSTRIAL APPLICABILITY

In engines that have valve trains that do not include hydraulic lash adjusters ("HLAs"), it may be desirable to retrofit the engine with a rocker arm assembly that incorporates HLAs. Retrofitting the engine with this type of rocker arm assembly, however, may require expensive components of the engine system to be replaced. For example, the retrofitted rocker arm assemblies must meet an emission drop-in requirement, and an HLA generally requires a new camshaft to be able to meet this emission drop-in requirement, which requires additional time and expense Referring to FIG. 1, a rocker arm assembly 100 (that do not include an HLA) may include a rocker arm 102 having a front end 116 that connects to a valve bridge 110 of the valve assembly 108. This connection between the rocker arm 102 and the valve bridge 110 includes a gap (or lash) that allows for thermal expansion of the components during use of the engine 100. The pushrods 104 of the rocker arm assembly 100 may have a cam follower (not shown, see, for example, cam follower 228 shown in FIG. 2) that are configured to engage with a camshaft (not shown, see, for example, camshaft 230 shown in FIG. 2) such that the pushrod 104 causes the rocker arm 102 to move between a first position in which the valve 112 of the valve assembly 108 is closed, and a second position in which the valve 112 is open. A cam lobe (not shown) of the cam shaft is configured to engage the cam follower of the pushrod 104 to cause the rocker arm 102 to move between the first and second positions. The camshaft and cam lobe are typically sized and shaped to account for the gap between the front end 116 of the rocker arm 102 and the valve bridge 110 such that the valve 112 of the valve assembly 108 opens and closes as desired.

When a rocker arm assembly 100 having an HLA 232 is retrofitted to replace the rocker arm assembly shown in FIG. 1, the HLA 232 substantially eliminates the gap (or lash) between the front end 116 of the rocker arm 102 and the valve bridge 110. As a result, the camshaft and cam lobe are no longer properly sized for the rocker assembly 100 because of the elimination of this gap, which may cause the valve 112 to no longer open and close as desired. In these circumstances, in order to have the valve 112 open as desired, the camshaft may need to be replaced, which requires additional time and expense.

Referring to the embodiments shown in FIGS. 2-6, the retrofitted rocker arm assembly 100 has a pushrod 102 that includes an HLA 232 that is configured to be attached to the second end 118 of a rocker arm 102. The retrofitted rocker arm assembly 100 is advantageous because it can be retrofitted into an engine 101 without needing to replace the camshaft, which reduces the time and costs associated with adding an HLA to the valvetrain. The HLA 232 includes a housing 341, a first body member 340, a second body member 342, and a third body member 344, in which these body members are configured to move relative to each other and the housing 341. The radial clearances of these body members 340 342, 344 allow the body members to move relative to each other and the housing 341 as the rocker arm 102 moves between the first and second positions. These radial clearances allow the rocker arm assembly 100 to be retrofitted into the system shown in FIG. 1 without needing to replace the camshaft. That is, although an HLA of the retrofitted rocker arm assembly (e.g., rocker arm assembly 100 in FIGS. 2-6) typically eliminates the gap that existed in the original rocker arm assembly (e.g., rocker arm assembly 100 in FIG. 1) between the front end 116 of the rocker arm 102 and the valve bridge 110, the radial clearances of the body members 340, 342, 344 of the HLA 232 are able to absorb movement of the retrofitted rocker arm assembly to compensate for the eliminated gap of the original rocker arm assembly, which allows the retrofitted rocker arm assembly to be retrofitted into an engine without requiring the replacement of the camshaft.

Referring to the embodiments shown in FIGS. 7-10, the retrofitted rocker arm assembly 100 has a rocker arm 102 that includes an HLA 232 that is configured to be attached to a valve assembly 108 of an engine. The retrofitted rocker arm assembly 100 is advantageous because it can be retrofitted into an engine 101 without needing to replace the camshaft, which reduces the time and costs associated with adding an HLA to the valvetrain. The HLA 232 includes a housing 341, a first body member 340, and a second body member 342, in which these body members are configured to move relative to each other and the housing 341. The radial clearances of these body members 340 342 allow the body members to move relative to each other and the housing 341 as the rocker arm 102 moves between the first and second positions. These radial clearances allow the rocker arm assembly 100 to be retrofitted into the system shown in FIG. 1 without needing to replace the camshaft. That is, although an HLA of the retrofitted rocker arm assembly (e.g., rocker arm assembly 100 in FIGS. 7-10) typically eliminates the gap that existed in the original rocker arm assembly (e.g., rocker arm assembly 100 in FIG. 1) between the front end 116 of the rocker arm 102 and the valve bridge 110, the radial clearances of the body members 340, 342 of the HLA 232 are able to absorb movement of the retrofitted rocker arm assembly to compensate for the eliminated gap of the original rocker arm assembly, which allows the retrofitted rocker arm assembly to be retrofitted into an engine without requiring the replacement of the camshaft.

In addition, referring to FIGS. 8 and 10, the retrofitted rocker arm assembly 100 may include an adjustment fastener 780 for adjusting one or more of the clearances 884, 892, 896 between the body members 340, 342 and/or the housing 341. The adjustment of the clearances 884, 892, 896 may also allow the retrofitted rocker arm assembly 100 to be retrofitted into the engine without requiring the replacement of the camshaft.

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein.

Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

LIST OF ELEMENTS

| Element Number | Element Name |
|---|---|
| 100 | rocker arm assembly |
| 101 | engine |
| 102 | rocker arm |
| 104 | pushrod |
| 108 | valve assembly |
| 110 | valve bridge |
| 112 | valve |
| 113 | valve seat |
| 114 | valve spring |
| 116 | first end of rocker arm |
| 118 | second end of rocker arm |
| 228 | cam follower |
| 230 | camshaft |
| 232 | hydraulic lash adjuster ("HLA") |
| 320 | internal cavity of rocker arm |
| 322 | oil passage |
| 323 | oil passage |
| 324 | rocker shaft |
| 326 | bearing |
| 327 | first pressure area |
| 329 | second pressure area |
| 334 | longitudinally-extending oil passage |
| 336 | fastener |
| 340 | first body member |
| 340a | outer surface of first body member |
| 341 | housing |
| 341a | inner surface of housing |
| 342 | second body member |
| 342a | outer surface of second body member |
| 342b | inner surface of second body member |

-continued

| LIST OF ELEMENTS | |
|---|---|
| Element Number | Element Name |
| 344 | third body member |
| 344a | outer surface of third body member |
| 346 | check valve |
| 348 | biasing member |
| 356 | top portion of housing |
| 450 | top surface of first body member |
| 452 | bottom surface of first body member |
| 454 | oil passage of first body member |
| 458 | opening of second body member |
| 460 | bore of second body member |
| 462 | bore of third body member |
| 464 | bore of housing |
| 466 | connection element of first body member |
| 468 | connection element of housing |
| 470 | arm of pushrod |
| 670 | first portion of first body member |
| 672 | second portion of first body member |
| 836 | fastener of valve assembly |
| 850 | bottom surface of second portion of first body member |
| 856 | bottom portion of housing |
| 858 | opening of second body member |
| 860 | bore of second body member |
| 862 | bore of first body member |
| 882 | opening of housing |
| 884 | clearance between housing and second body member |
| 886 | top portion of housing |
| 888 | top surface of second body member |
| 890 | surface of second body member |
| 892 | clearance between first body member and second body member |
| 894 | top surface of first body member |
| 896 | clearance between second portion of first body member and housing |

The invention claimed is:

1. A retrofitted rocker arm assembly for an engine, comprising:

a rocker shaft;

a rocker arm connected to the rocker shaft such that the rocker arm can pivot relative to the rocker shaft, the rocker arm having a first end, a second end, and a first oil passage;

a pushrod having a top end and a bottom end, the top end being connected to the second end of the rocker arm and the bottom end configured for engaging a camshaft of the engine, wherein the top end of the pushrod includes a hydraulic lash adjuster that comprises:

a housing;

a first body member disposed in the housing such that a first radial clearance exists between an outer surface of the first body member and an inner surface of the housing, the first body member comprising a second oil passage that is in fluid communication with the first oil passage of the rocker arm;

a second body member disposed in the housing such that a second radial clearance exists between an outer surface of the second body member and the inner surface of the housing, wherein the second body includes a first bore and an opening that is in fluid communication with the second oil passage of the first body member;

a third body member disposed in the first bore of the second body member such that a third radial clearance exists between an outer surface of the third body member and an inner surface of the first bore of the second body member, wherein the third radial clearance is less than both the first radial clearance and the second radial clearance, and wherein the third body member comprises a second bore;

a check valve configured to allow oil to flow through the opening of the second body member when the check valve is in an open position and configured to prevent the flow of oil through the opening when the check valve is in a closed position; and a biasing member disposed in the second bore of the third body member.

2. The retrofitted rocker arm assembly according to claim 1, wherein the second radial clearance is less than the first radial clearance.

3. The retrofitted rocker arm assembly according to claim 1, wherein the first radial clearance is between about 40 microns and about 120 microns, wherein the second radial clearance is between about 40 microns and about 80 microns, and wherein the third radial clearance is between about 10 microns and about 30 microns.

4. The retrofitted rocker arm assembly according to claim 1, wherein the outer surface of the first body member, the outer surface of the second body member, and the inner surface of the housing at least partially define a first pressure area; wherein the inner surface of the first bore of the second body member and the outer surface of the third body member at least partially define a second pressure area; and wherein a first oil pressure in the second pressure area exceeds a second oil pressure in the first pressure area.

5. The retrofitted rocker arm assembly according to claim 4, wherein the first oil pressure can be between about 10 MPa and about 40 MPa.

6. The retrofitted rocker arm assembly according to claim 1, wherein the housing comprises a third bore, and wherein the third body member is disposed in the third bore.

7. The retrofitted rocker arm assembly according to claim 1, wherein the housing comprises a retaining clip for retaining the first body member within the housing.

8. The retrofitted rocker arm assembly according to claim 1, wherein the first body member, the second body member, and the third body member are made of hardened steel.

9. A retrofitted rocker arm assembly for an engine, comprising:

a rocker shaft;

a rocker arm connected to the rocker shaft such that the rocker arm can pivot relative to the rocker shaft, the rocker arm having a first end, a second end, and a first oil passage, wherein the first end includes a hydraulic lash adjuster that comprises:

a housing comprising a first opening that is in fluid communication with the first oil passage;

a first body member disposed in the housing, the first body member comprising a first bore;

a second body member disposed in the housing such that a first radial clearance exists between an outer surface of the second body member and the inner surface of the housing, wherein the second body includes a second bore and a second opening that is in fluid communication with the first opening of the housing, wherein the first body member is disposed within the second bore of the second body member such that a second radial clearance exists between an inner surface of the second body member and an outer surface of the first body member, wherein the second radial clearance is less than the first radial clearance;

a check valve configured to allow oil to flow through the second opening of the second body member when the check valve is in an open position and configured to prevent the flow of oil through the second opening when the check valve is in a closed position; and a biasing member disposed in the first bore of the first body member; and a pushrod having a top end and a bottom end, the top end being connected to the second end of the rocker arm and the bottom end configured for engaging a camshaft of the engine.

10. The retrofitted rocker arm assembly according to claim 9, wherein the first radial clearance is between about 40 microns and about 120 microns, and wherein the second radial clearance is between about 10 microns and about 30 microns.

11. The retrofitted rocker arm assembly according to claim 9, the outer surface of the second body member and the inner surface of the housing at least partially define a first pressure area; wherein the inner surface of second bore of the second body member and the outer surface of the first body member at least partially define a second pressure area; and wherein a first oil pressure in the second pressure area exceeds a second oil pressure in the first pressure area.

12. The retrofitted rocker arm assembly according to claim 11, wherein the first oil pressure can be between about 10 MPa and about 40 MPa.

13. The retrofitted rocker arm assembly according to claim 9, further comprising an adjustment fastener for adjusting a clearance between the first body member and the second body member, wherein the adjustment fastener is disposed on the first end of the rocker arm.

14. The retrofitted rocker arm assembly according to claim 9, further comprising an adjustment fastener for adjusting a clearance between the first body member and the second body member, wherein the adjustment fastener is disposed on the second end of the rocker arm.

15. The retrofitted rocker arm assembly according to claim 9, wherein the housing comprises a retaining clip for retaining the first body member within the housing.

16. The retrofitted rocker arm assembly according to claim 9, wherein the first body member and the second body member are made of hardened steel.

17. A method for retrofitting a rocker arm assembly for an engine, the method comprising:

removing a first rocker arm assembly from the engine such that a camshaft of the engine remains in the engine;

providing a second rocker arm assembly that comprises:

a rocker shaft;

a rocker arm connected to the rocker shaft such that the rocker arm can pivot relative to the rocker shaft, the rocker arm having a first end, a second end, and a first oil passage;

a pushrod having a top end and a bottom end, the top end being connected to the second end of the rocker arm and the bottom end configured for engaging the camshaft of the engine;

a hydraulic lash adjuster comprising:

a housing;

a first body member disposed in the housing such that a first radial clearance exists between an outer surface of the first body member and an inner surface of the housing, where the first body member comprises a first bore and an opening in fluid communication with the first oil passage of the rocker arm;

a second body member disposed in the first bore of the first body member such that a second radial clearance exists between the inner surface of the first bore of the first body member and an outer surface of the second body member, wherein the second radial clearance is less than the first radial clearance, wherein the second body member comprises a second bore;

a check valve configured to allow oil to flow through the opening of the first body member when the check valve is in an open position and configured to prevent the flow of oil through the opening when the check valve is in a closed position; and a biasing member disposed in the second bore of the second body member; and inserting the second rocker arm assembly into the engine such that the bottom end of the pushrod engages the camshaft of the engine and the front end of the rocker arm engages a valve assembly of the engine.

18. The method according to claim 17, wherein the hydraulic lash adjuster of the second rocker arm assembly is disposed in the top end of the pushrod, and wherein the second rocker arm assembly further comprises a third body member disposed in the housing such that a third radial clearance exists between an outer surface of the third body member and the inner surface of the housing, wherein the third radial clearance is greater than or equal to the first radial clearance, wherein the third body member includes a second oil passage that is disposed between and in fluid communication with the first oil passage of the rocker arm and the opening of the first body member.

19. The method according to claim 18, wherein the first radial clearance is between about 40 microns and about 80 microns, wherein the second radial clearance is between about 10 microns and about 30 microns, and wherein the third radial clearance is between about 40 microns and about 120 microns.

20. The method according to claim 17, wherein the hydraulic lash adjuster of the second rocker assembly is disposed in the first end of the rocker arm, wherein the first radial clearance is between about 40 microns and about 120 microns, wherein the second radial clearance is between about 10 microns and about 30 microns.

* * * * *